United States Patent [19]

Schulzen, deceased et al.

[11] Patent Number: 4,892,556

[45] Date of Patent: Jan. 9, 1990

[54] PROCESS FOR TRANSFER PRINTING ON LEATHER SUBSTRATES IMPREGNATED WITH AMINOPLAST PRE-CONDENSATE

[76] Inventors: Herbert W. A. Schulzen, deceased, late of Bad Schwalbach; Elisabeth A. Schulzen, heir; Holger Schulzen, heir, both of Wilhelmstrasse 33, 6208 Bad Schwalbach-Hettenhain; Petra S. Schulzen, heir, An der Ringkirche 5, 6200 Wiesbaden, all of Fed. Rep. of Germany

[21] Appl. No.: 940,926

[22] Filed: Dec. 12, 1986 (Under 37 CFR 1.47)

[30] Foreign Application Priority Data

Dec. 14, 1985 [DE] Fed. Rep. of Germany ..... 3544239

[51] Int. Cl.[4] ..... D06P 3/32; D06P 1/56; B41M 1/38; D06M 15/39

[52] U.S. Cl. ..... 8/436; 8/471; 8/496; 8/916

[58] Field of Search ..... 8/436, 471, 496

[56] References Cited

U.S. PATENT DOCUMENTS 4,088,440 5/1978 Leimbacher et al. ..... 8/471
4,411,667 10/1983 Meredith et al. ..... 8/471

*Primary Examiner*—A. Lionel Clingman
*Attorney, Agent, or Firm*—Austin R. Miller

[57] ABSTRACT

In a process for printing on leather substrates using the transfer printing method by surface treatment of the substrate, applying an auxiliary carrier which is printed on with sublimable dyes and transferring the dyes to the substrate by dry heat treatment, the surface of the substrate is impregnated with an aqueous solution of a pre-condensate of a urea aldehyde resin or melamine aldehyde resin, the solvent is removed at a temperature which still does not cause condensation of the pre-condensate, and the dyes are transferred at a temperature of between 140° and 250° C. for a sufficiently long time for the pre-condensate to condense out at the same time.

10 Claims, No Drawings

PROCESS FOR TRANSFER PRINTING ON LEATHER SUBSTRATES IMPREGNATED WITH AMINOPLAST PRE-CONDENSATE

European patent specification No. 14 901 discloses a process for printing on a substrate which is resistant to being heated above 220° C., using the transfer printing process, by coating the substrate with a plastics material which has an affinity to the printing dyes, applying to the plastics coating an auxiliary carrier which has sublimable dispersion dyes printed thereon, and transferring the dispersion dyes into the plastics coating by a dry heat treatment. The plastics material used for coating the substrate are cross-linkable thermosetting materials from the group consisting of phenoplastics, aminoplastics, polyesters, polyphenylene sulphide resins, silicone resins, acrylate resins, alkyde resins, polyethylene sulphide resins and/or unsaturated polyester resins. When using that or a similar lacquer coating process on leather, the surface thereof is totally changed in respect of its mechanical properties and its appearance so that such a process is not suitable for printing on leather. The same disadvantage is found in the known operation of coating leather with polyurethanes as the surface takes on a plastics character and loses the typical feel of leather.

German laid-open application (DE-OS) No 24 36 783 discloses impregnating flat textile materials which entirely or partially consist of cellulose fibres with a cross-linking agent for the cellulose, which is suitable for reacting with the hydroxyl groups of the cellulose, cross-linking the cellulose and thereby improving its dimensional stability and its resistance to creasing or wrinkling. In that respect, considered as cellulose cross-linking agents are acetals, as reaction products from formaldehyde and diethylene glycol, dimethylol monocarbamates, substituted urea derivatives, triazones, melamine compounds and epoxides as well as aldehydes. As leather is not comparable structurally to cellulose but is made up from albumin substances, the men skilled in the art have never used such a process which is known in relation to cellulose, for leather. Moreover, with that known process, the resistance to tearing and folding as well as resistance to bleaching, in regard to cotton, are impaired. That necessarily deterred the man skilled in the art from using such a process.

Insofar as printing was applied to leather, that was therefore done in the past using inorganic dyes and binding agents by means of a screenprinting process, which suffered from serious disadvantages as a screenprinting process does not permit the production of halftones and each shade requires its own printing operation.

The need on the part of the leather industry for printing on leathers, for example to give inexpensive skivers the appearance of high-grade kinds of leather or in order directly to produce batik leathers and shadow leathers has risen greatly in recent years.

Therefore the underlying object of the present invention is to provide a process with which it is possible to print on leather in a manner which is of the utmost simplicity, in a high-quality form, without disadvantageously altering the mechanical properties, appearance and feel of the leather.

The process according to the invention for printing on leather substrates using the transfer printing process by surface treatment of the substrate, applying an auxiliary carrier which is printed with sublimable dyes and transferring the dyes onto the substrate by dry heat treatment, is characterised in that the substrate surface is impregnated with an aqueous solution of a pre-condensate of a urea aldehyde resin or melamine aldehyde resin, the solvent is removed at a temperature which still does not cause condensation of the pre-condensate and the dyes are transferred at a temperature of between 140° and 250° C. for a sufficiently long period of time for the pre-condensate to condense out at the same time.

It is surprising that such a process which is similar in certain respects to that disclosed in German laid-open application (DE-OS) No 24 36 783 can be applied to leather as the latter does not have available therein any hydroxyl groups which are comparable to cellulose, with which a reaction could occur, with bridge formation. It is also surprising that with the process according to the invention the resistance to tearing and folding is not reduced and likewise the bleaching resistance and chemical cleaning resistance or fastness are maintained. The man skilled in the art would not have expected those results, having regard to the processes which are known in respect of cotton, with their adverse effect on the level of resistance to tearing and folding as well as the level of bleaching resistance.

In comparison with other transfer printing processes, the process according to the invention has the advantage that the feel and the appearance of the treated leather which has been printed on are not changed in comparison with untreated leather so that the treatment operation never gives rise to the impression of an artificial product. Therefore, without losing or adversely affecting the natural properties of the leather, it is possible to print any coloured patterns or images on leather and for example to produce the appearance of high-quality leather on the surfaces thereof. Irrespective of the preceding tanning methods, the process can be applied to all kinds of leathers such as cow hide, calf leather, buff leather, horse leather, sheep and lamb's leather, kid leather, pigskin leather, red deer leather, chamois leather, antelope leather, elk or moose leather, reindeer leather, camel leather, kangaroo leather and the like. It is also possible in that way to print on leathers which were tanned with vegetable tanning materials, that is to say with tannin-bearing barks, fruits, leaves and woods of native and foreign plants. Those qualities of leather which were produced with aromatic-synthetic tanning materials can be used just as can those qualities of leather which were produced with aliphatic-synthetic tanning materials, and they exhibit practically identical results after the printing operation.

However the process is particularly suitable for printing on mineral-tanned qualities of leather, in particular those which were subjected to chrome tanning. That is a point of particular significance as chrome leather as such has superior properties, as it is resistant to water and heat and has particularly good strength properties. Thus it is possible in accordance with the invention and without any problems to print on cow box from cow hides, horse box from horse hides, box calf from calf hides, kid from kid hides, chrome-dressed sheep's uppers, chrome velours leather with dressed ground inward side and nubuk leather with ground grain side.

The degrees of fastness to light, bleaching and cleaning of the printing are excellent, which was not to be expected by the man skilled in the art. In addition, the preliminary treatment in accordance with the process of the invention produces post-tanning of the leather which further improves the properties thereof.

The level of concentration of the aqueous impregnation solution may vary within wide limits. A preferred level of concentration of the pre-condensate is from 4 to 12%.

The aldehyde component in the pre-condensate is preferably formaldehyde but it may also be glyoxal, glutaraldehyde or another aldehyde. Epichlorhydrin may also be used as a component equivalent to the aldehyde.

The urea may be unsubstituted or substituted, such as dimethylolurea, a cyclic dimethylolurea compound, such as a dimethylol compound of ethyleneurea, dihydroxy ethylene urea, propylene urea and derivatives thereof. The melamine component of the pre-condensate may also be unsubstituted or substituted, such as a methylol melamine compound, such as tetramethylol melamine, or a water-soluble etherified methylol melamine compound.

The pre-condensates which are preferably used are thus urea formaldehyde resins or melamine formaldehyde resins of unsubstituted or substituted urea and melamine components.

Preferably, acid or potentially acid-reacting catalysts are also added to the impregnation solution, such as magnesium chloride, diammonium sulphate, zinc nitrate, zinc chloride or magnesium nitrate. Other suitable catalysts are the metal salts of polycarboxylic acids such as magnesium, zinc, aluminium, zirconium, iron, nickel, copper and sodium salts of ethylene diaminotetraacetic acid, nitrilotriacetic acid, diethylene triaminopentaacetic acid, citric acid, tartaric acid or succinic acid. In that respect the dimagnesium salt of ethylene diaminotetraacetic acid is particularly suitable.

Alternatively or in addition to impregnation of the surface of the leather with a catalyst-bearing aqueous solution, the catalyst may also be incorporated into the auxiliary carrier for the transfer printing operation, such as for example magnesium chloride, with which the paper that acts as the auxiliary carrier is impregnated.

Impregnation of the surface of the leather with the impregnation solution which contains the pre-condensate alone or together with catalyst and possibly other auxiliary materials is desirably effected by spraying the surface of the leather with the aqueous solution or suspension. It diffuses into the micellar cavities until saturation thereof occurs. Then, drying is carefully carried out at a temperature at which the solvent water of the impregnation solution is removed from the surface of the leather but at which no condensation of the pre-condensate is yet effected. The drying temperature is desirably 120° at a maximum, preferably 110° C. at a maximum, while the drying operation can be promoted by applying a vacuum. In that drying treatment, the pre-condensate and possibly catalyst is deposited in the micellar cavities and substantially not on the surface of the leather. That has the advantage that the appearance and feel of the leather are practically unaltered in comparison with the untreated product, due to the pre-condensate condensing out.

The transfer printing operation, that is to say transfer of the dyes from the auxiliary carrier onto the surface of the leather, is carried out by heating to a temperature of between 140° and 250° C. The heating operation can be carried out on a discontinuous press or a continuous calander. At the specified temperature, not only are the dyes sublimed from the auxiliary carrier onto and into the surface of the leather but at the same time the pre-condensate is also condensed out; in that respect care must be taken to ensure that the heating period is sufficient to effect adequate condensing out of the pre-condensate.

Preferred temperatures are in the range of from 160° to 220° C., in particular in the range of from 180° to 200° C. or from 180° to 220° C.

In that print transfer operation under heating conditions, the dyes are converted in a purely physical process into a gaseous condition and sublime 20 to 60 μm into the surface of the leather. Condensation of the pre-condensate, which occurs at the same time, takes place under the catalytic influence of the added acid catalyst and/or under catalytic influence of the mineral tanning material which is incorporated into the surface of the leather, such as $Cr_2O_3$ or $Al_2O_3$, with molecules of water coming out to form a larger molecule which has dye-affinity. As that larger molecule is formed in the micropores of the surface of the leather, the dye is simultaneously fixed in those pores.

In addition, a chemical reaction occurs between the aldehyde, in particular formaldehyde, with the complex albumin substances, representing post-tanning at temperatures which hitherto were strictly avoided in processing leather.

With the action of the formaldehyde on the proteins, a chemical reaction first occurs, forming methylene amino compounds:

$$HOOC—R—NH_2+HCHO\rightarrow HOOC—R—N{=}CH_2+H_2O.$$

However formaldehyde reacts not only with free amino groups but also with acid amides, forming methylol compounds:

$$R—CO—NH_2+HCHO\rightarrow R—CO—NH—CH_2—OH.$$

Cyclic peptide compounds also react with formaldehyde, like the two acid amide groups of diketopiperazine, forming dimethyldiketopiperazine.

The unusually high level of resistance to migration of the printed leather, which is achieved by means of the process according to the invention, is also produced by covalent colloid reactions, irreversible hardening of the molecule lattice occuring due to methylene bridges between regularly recurring peptide groups of parallel-disposed polypeptide chains. In that respect resistance to migration means that the dyes do not move or virtually do not move within the surface of the leather and thus smear the printed pattern or image or change it to gray tones.

Certain types of dyes are found to be particularly suitable in the process according to the invention.

A particularly advantageous type of dye is fat- or oil-soluble dyes, in particular those which can be put into a gaseous state of aggregation between 160° and 220° C. Such dyes are for example azo dyes and anthraquinone dyes which dissolve in fats, oils, waxes, resins, hydrocarbons, chlorohydrocarbons, alcohols, ethers and the like but not in water. Such dyes are known for example by the name "Sudan dyestuffs" (a BASF trademark). Hitherto such dyes were used for colouring mineral oil products such as carburettor fuels, diesel oil, heating oil and the like, mineral oil fractions, wax products such as shoe cream, floor polishes, candles and the like. They are also incorporated in sun-screen agents and used for the production of pyrotechnic articles for producing coloured smokes.

Other such fat- or oil-soluble dyes are aminoazo dyes and oxyazo dyes, such as for example those of the following formulae:

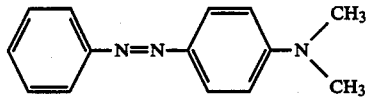

p-Dimethylamino-azobenzene

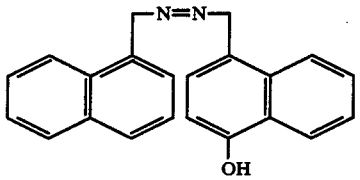

Sudan brown
(pigment brown)

Other groups of such fat- and oil-soluble dyes are monoazo-, diazo-, azomethine-, quinoline-, ketoimine-dyes, complexes of acid and basic dyes, acridines, xanthenes, triarylmethanes, anthraquinoid dyes and phthalocyanine compounds.

Examples of such dyes are set forth in Colour-Index, Volume 2, pages 2815 to 2905, as for example:

Sudan yellow GG=CI Solvent yellow 2
Oganol orange 2R=CI Solvent orange 2
Sudan red 3R=CI Solvent red 18
Orasol violet 3B=CI Solvent violet 6
Sudan blue GA=CI Solvent blue 11
Sudan brown BB=CI Solvent brown 5.

Such dyes have only slight fastness in respect of light, when printed on paper. It is all the more astonishing that, when printed onto pretreated leather in accordance with the invention, they have good to excellent fastness in respect of light. When considered coloristically, such dyes can be adjusted in a particularly sensitive manner to reproducible fashion shades.

A further group of dyes which is advantageous in regard to the process according to the invention is the group of basic dyes. They have particularly bright colours and good levels of fastness in use.

The interaction between the surface of the leather and a basic dye may be reproduced diagrammatically as follows:

$$[L.COO]^- + [Fb.NH_3] + [L.COO]^- + [H_3N.Fb]$$

Leather anion, Dye cation  Dye salt

L = leather residue
Fb = dye residue

The cationic dyes are generally those from the monoazo series such as aminoazo dyes which are produced by coupling of diazonium salts with amines. Examples are as follows:

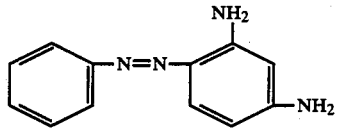

Chrysoidine

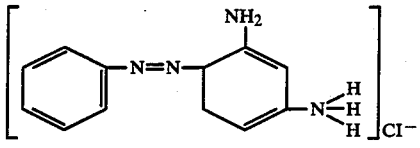

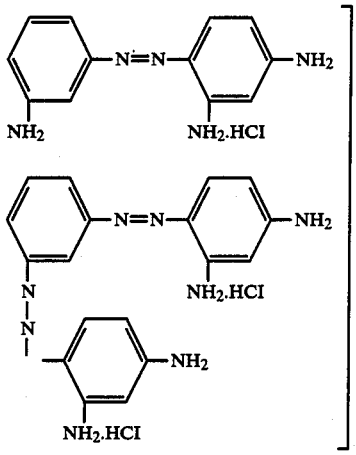

Bismarck brown

Basic cyamino dyes (polymethine dyes) of asymmetrical structure can also be considered.

A third group of dyes which can be advantageously used in the process according to the invention is that of dispersion dyes which are also used in relation to other transfer printing processes but which do not have any affinity for proteins, wool or leather. Nonetheless, such dispersion dyes probes printing on leather which has resistance to bleaching, resistance to chemical cleaning and fastness in respect of light.

In particular those dispersion dyes which include reactive hydroxyl, amino, amide, sulpho or carboxyl groups may be considered.

The dispersion dyes which are used in accordance with the invention may be divided into two classes, having regard to the temperature performance such as softening, melting, coalescing, oxidising, decomposing etc.

The first class comprises low-molecular dispersion dyes or dye blends which preferably sublime between 100° and 170° C. The second class comprises higher-molecular dyes which sublime between 170° and 300° C., preferably between 180° and 220° C. They involve dyes of the following classes: anthraquinoid dyes such as hydroxy and/or amino anthraquinones, azo dyes, quinophthalone dyes, azomethine dyes, stilbene dyes and nitrodiarylamines.

Such usable dyes are described in the Journal of the Society of Dyers and Colorists, Volume 70, pages 69 to 71 (1954) and Volume 74, page 389 (1958). Preferred are dyes with characteristic hydrophobic properties, that is to say of lower polarity and lower molecular weight, which as far as possible should be below 1000.

Examples of such dyes are the following compounds: 1-amino-2-phenoxy-4-hydroxyanthraquinone, 4-phenylazo-N-phenylaniline, 1,4-diamino-2-methoxyanthraquinone, 1,4-diaminoanthraquinone, 3-methyl-4-p-nitrophenylazo-N,N-dihydroxyethylaniline, 1,4-dimethylaminoanthraquinone, 1,4,5,8-tetraaminoanthraquinone and analogue compounds.

Examples of dispersion dyes which can also be used in the present process are to be found in German patent specification No. 2 642 350 and European patent specification No 14 901. Reference is made herein to the dyes and groups of dyes described therein. Dispersion dyes which are preferably used are anthraquinone, monoazo and/or azomethine dyes.

I claim:

1. A process for printing on leather substrates using the transfer printing process by surface treatment of the substrate, applying an auxiliary carrier which is printed with sublimable dyes and transferring the dyes onto the substrate by dry heat treatment characterized in that the substrate surface is impregnated with an aqueous solution of a pre-condensate of a urea formaldehyde resin or melamine formaldehyde resin, the solvent is removed at a temperature of up to a maximum of 120° C. which does not cause condensation of the pre-condensate and the dyes are transferred at a temperature of between 140° and 250° C. for a sufficiently long period of time for the pre-condensate to condense out at the same time.

2. A process according to claim 1 characterised by using a 4 to 12% aqueous solution of the pre-condensate.

3. A process according to claim 1 or claim 2 characterised by using a pre-condensate of a urea formaldehyde resin or melamine formaldehyde resin.

4. A process according to one of claims 1 to 3 characterised in that the dyes are transferred at a temperature in the range of from 160° to 220° C.

5. A process according to 3 and one of claims 1 to 4 characterised by using an aqueous pre-condensate solution which additionally contains an acid catalyst.

6. A process according to 3 and 5 to one of claims 1 to 5 characterised by using an auxiliary carrier which is printed with basic dyes.

7. A process according to one of claims 1 to 3 and 4 to 5 characterised by using an auxiliary carrier which is printed with disperse dyes.

8. Use of the process according to claims 1 to 3, 4 to 5 and 6 to 7 for printing on mineral-tanned leather substrates.

9. A process according to one of claims 1 to 3 characterised in that the dyes are transferred at a temperature in the range of from 180° C. to 220° C.

10. A process according to one of claims 1, 2, 3, 4, 5, 6, 7 and 9 for printing on chrome-tanned leather substrates.

* * * * *